United States Patent [19]

Phillips

[11] Patent Number: 4,951,181

[45] Date of Patent: Aug. 21, 1990

[54] LIGHT DIFFUSING GLASS BLOCK FURNITURE

[75] Inventor: Jacob T. Phillips, Fort Myers, Fla.

[73] Assignee: Hardman and Phillips Partnership, Ft. Myers, Fla.

[21] Appl. No.: 417,787

[22] Filed: Oct. 4, 1989

[51] Int. Cl.[5] ..... A47B 97/00

[52] U.S. Cl. ..... 362/134; 362/130; 362/133; 362/801; 5/1; 312/223

[58] Field of Search ..... 5/1; 362/133, 130, 234, 362/253, 801, 127, 134; 128/376; 312/223

[56] References Cited

U.S. PATENT DOCUMENTS

| | | | |
|---|---|---|---|
| 2,418,877 | 4/1947 | Gustafson | 362/130 |
| 4,544,993 | 10/1985 | Kirk | 362/801 X |
| 4,742,437 | 5/1988 | Downey | 362/130 |

*Primary Examiner*—Stephen F. Husar

*Attorney, Agent, or Firm*—William E. Noonan

[57] ABSTRACT

An article of transportable furniture is provided including a generally planar platform portion and a base portion for supporting the platform portion. The base portion includes a plurality of interengaged glass blocks and a frame for enclosing the glass blocks. A light source is disposed within the base portion for providing illumination through the glass blocks.

16 Claims, 4 Drawing Sheets

LIGHT DIFFUSING GLASS BLOCK FURNITURE

FIELD OF THE INVENTION

This invention relates to articles of glass block furniture, and, more particularly, to beds, bars and other pieces of transportable furniture which employ glass block and interior lighting to provide a unique illuminated design.

BACKGROUND OF INVENTION

Furniture designers constantly strive to provide new and aesthetically pleasing designs. In this regard, various water beds have employed interior lighting techniques. In one of these systems, Downey U.S. Pat. No. 4,742,437, relatively small apertures are formed in the bed frame and full ambient lighting is not achieved. Moreover, because the waterbed mattress must be drained and removed to reach the light source, replacement of that light is quite inconvenient. To date, interior illumination has not been utilized for a conventional spring mattress bed.

Glass block has been employed for many years in walls and other permanent structures. However, heretofore it has not been used in constructing transportable items, such as furniture.

SUMMARY OF INVENTION

It is therefore an object of this invention to provide an article of illuminated glass block furniture which presents a unique and aesthetically pleasing appearance.

It is a further object of this invention to provide an article of internally illuminated furniture which presents an improved diffused lighting effect.

It is a further object of this invention to provide an article of glass block furniture that is sturdy and yet conveniently transportable.

It is a further object of this invention to provide an article of internally illuminated glass block furniture in which the internal light source is readily accessible for replacement.

It is a further object of this invention to provide a bed, bar, coffee table, entertainment center and other articles of furniture which utilize an internally illuminated glass block structure.

This invention results from a realization that glass bricks or blocks may be employed in a non-permanent, transportable manner to form various articles of furniture and that such furniture may be internally illuminated to provide an improved, aesthetically pleasing and wholly unique design wherein the light is diffused by the glass blocks.

This invention features an article of furniture including a generally planar platform portion and a base portion for supporting the platform portion. The base portion includes a plurality of interengaged glass blocks and a frame for enclosing the glass blocks. There is a light source disposed beneath the platform portion for providing illumination through the glass blocks.

In a preferred embodiment, means may be provided for interconnecting the platform portion with the base portion. The means for interconnecting may include dowel means that extend from one of the platform portion and the base portion and receptacle means formed in the other of the platform portion and the base portion for receiving the dowel means. The receptacle means may include groove means for slidably receiving the dowel means such that the platform portion may be adjusted relative to the base portion. The platform portion may include a pair of separable half sections. Means may be provided for selectively interconnecting the half sections. The platform portion may include a generally horizontal upper part and a lower part that depends from the horizontal part. Tile means may be attached to the lower part of the platform portion.

The base portion may include a single row of glass blocks. Transparent, color tinting material may be applied to the glass blocks. The frame may include a plurality of selectively interconnected sides. Means may be provided for adhering the glass blocks to the frame. Means may also be provided for adhering the adjacent blocks in a respective one of the sides. A molding element may be provided for interconnecting the glass block and the frame.

The base may include a plurality of junction sections which interconnect the sides. Each junction section may include a glass block that has one of a curved and an angled outer face, and upper and lower frame elements are disposed respectively above and below the glass block. The frame portion may include a plurality of tiles mounted to the outer face thereof. The base may include a compartment having an opening thereto and shelving means that are disposed in the compartment.

DISCLOSURE OF PREFERRED EMBODIMENTS

Other objects, feature and advantages will occur from the following description of a preferred embodiment and the accompanying drawings, in which.

Figure 1:
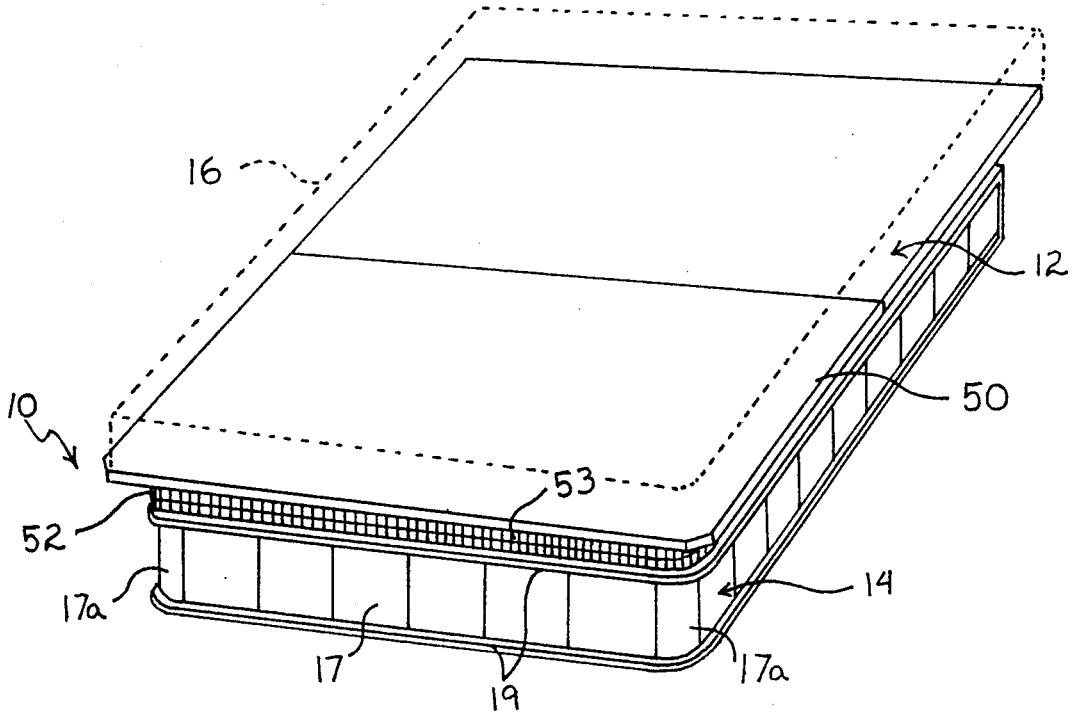
FIG. 1 is an isometric view of a glass block bed that is constructed according to this invention.

The furniture of this invention may comprise various types of articles of furniture, including beds, bars, coffee tables and entertainment centers. Each of the articles of furniture is constructed at least in part by glass bricks or blocks and a lighting source is provided beneath a platform, within an area enclosed by the glass blocks so that a unique ornamental appearance is achieved. Each article of furniture includes a generally planar platform portion. This portion may include the pedestal of a bed, a bar counter, a coffee table top or shelving of various types. A base portion supports the platform portion and includes a plurality of interengaged blocks and a frame for enclosing the glass blocks.

Complementary means such as dowels and holes may be provided for interconnecting the platform portion with the base portion. Typically, the dowels or other insertion members extend from the platform and are received by holes formed in the frame portion of the base. In certain embodiments, for example in the bed, the base may be constructed of several side portions which are interconnected by dowels and holes similar to those described above. The platform may also be formed from multiple parts which are selectively interconnected. Tiles or other ornamental features may be applied to a depending section of the platform portion.

The above construction allows the articles of furniture to be quickly and relatively easily assembled and disassembled so that the furniture may be conveniently transported. Each side of the base portion of the bed may include a plurality of glass blocks that are bounded along their upper and lower edges by frame elements. The frame elements and the blocks are interengaged by various types of adhesive such as silicone or vulkem sealant.

The glass blocks which are utilized in this invention are conventional glass blocks which have heretofore been used exclusively as permanent construction materials. This invention uniquely employs such glass blocks in furniture and distinctively allows the glass blocks to be arranged and transported. The platform and the frame elements of the base typically comprise wood, but may include various other materials.

The light source that is disposed beneath the platform within the area defined by the base may be incandescent, fluorescent or any other type of lighting. Multiple bulbs and various powers may be employed. Typically, the light source is activated by a manually operated or timed switch which is located on the bed's headboard or platform. The illumination provided by the lighting source is diffused by the glass blocks to provide the furniture with a unique ornamental and aesthetically pleasing appearance. This appearance can be further affected by tinting the light source and/or the glass blocks. Not only does the lighted glass block bed provide an improved aesthetic furniture design, the internal light source serves as an effective night light which can be helpful to children and the elderly, in particular. The lighting effects also provide a pleasant and romantic aura.

Figure 2:
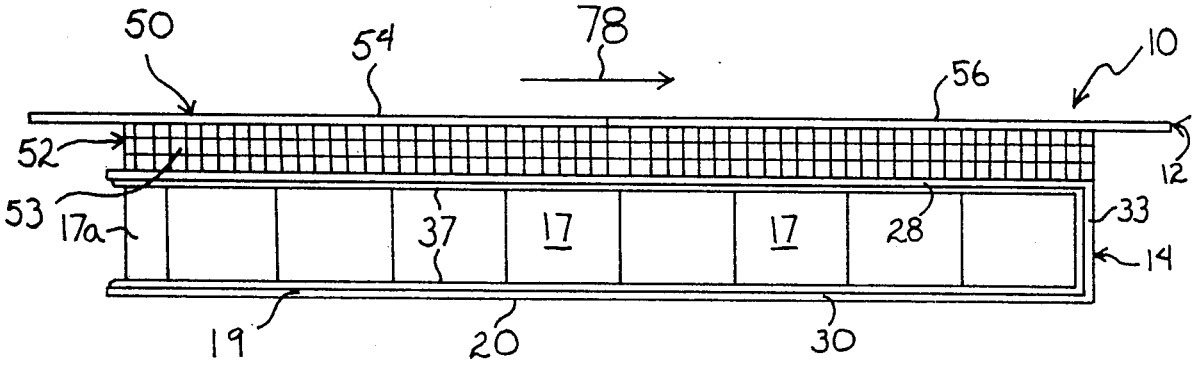
FIG. 2 is an elevational side view of the bed of FIG. 1.
Figure 3:
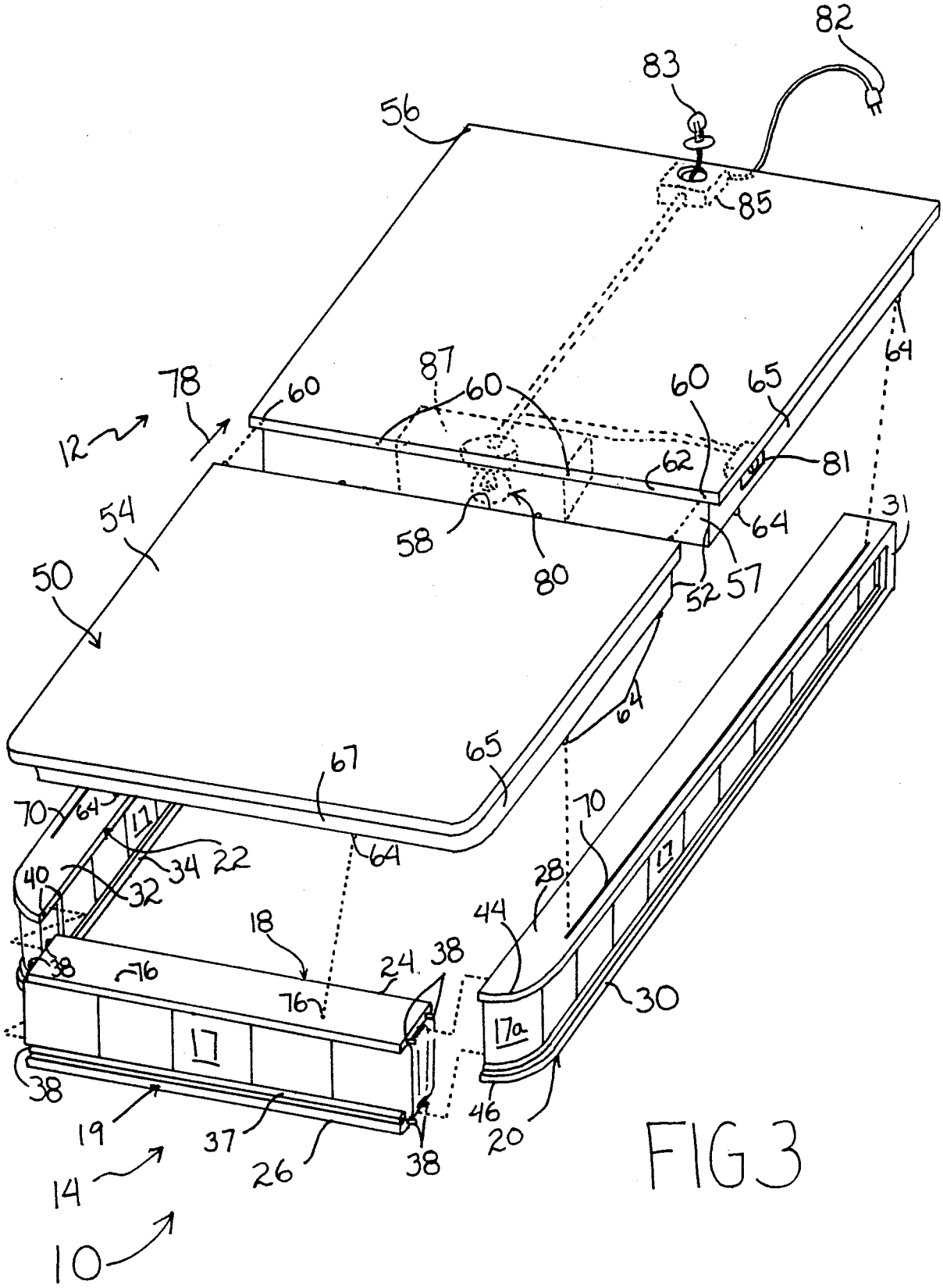
FIG. 3 is an exploded view of the bed, illustrating the internal light source.

There is shown in FIGS. 1 through 3 a glass block bed 10 that includes a generally planar platform portion 12 and a base portion 14 for supporting platform portion 12. A conventional mattress 16 or soft sided waterbed, shown in phantom in FIG. 1, is placed upon the upper surface of platform portion 12. Base 14 includes a plurality of interengaged glass blocks 17, that are arranged in a single row, and a peripheral frame 19 that encloses the glass blocks.

As shown most clearly in FIG. 3, base 14 includes three selectively interconnectable sides 18, 20 and 22. Side 18 forms the foot of the bed and sides 20 and 22 form left and right side respectively of the bed. A fourth side is typically not required. At this end of the bed a headboard is placed. Alternatively, the base 14 may be placed against a wall. Each of the sides 18, 20 and 22 includes a single row of glass blocks 17 and upper and lower frame elements that extend respectively along the top and bottom edges of the row of glass blocks. For example, side 18 includes an upper frame element 24 and a lower frame element 26. Side 20 includes an upper frame element 28 and a lower frame element 30, and side 22 includes an upper frame element 32 and a lower frame element 34. Left side 20 further includes a vertical frame element 33, FIG. 2, at one end interconnecting upper and lower frame elements 28 and 30. Similarly, as shown in FIG. 3, side 22 includes a vertical frame element 31 that interconnects upper and lower frame elements 32 and 34. The vertical and horizontal frame elements of sides 20 and 22 include mitered corners as shown in FIG. 3. In each side, the vertical and horizontal frame elements may be joined by adhesive or other suitable attachment means.

Figure 4:
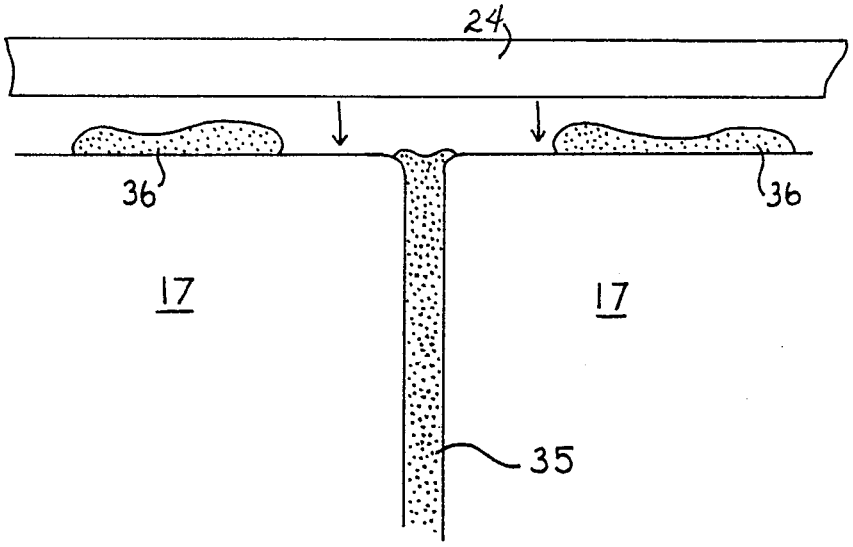
FIG. 4 is a partial, elevational view of the base and the adhesive for interconnecting the adjacent glass blocks and the base frame.

As shown in FIG. 4, adjoining blocks 17 are adhered together by silicone or an alternative adhesive 35. A similar adhesive 36 is employed to secure the frame elements, for example frame element 24, to the upper and lower edges of the rows of glass blocks 17. Elongate strips of molding 37, FIGS. 2 and 3, may be disposed in the upper and lower corners formed by the glass blocks 17 and the upper and lower frame elements. Such molding 37 may be attached to the glass blocks and the frame elements by conventional adhesive means.

Figure 5:
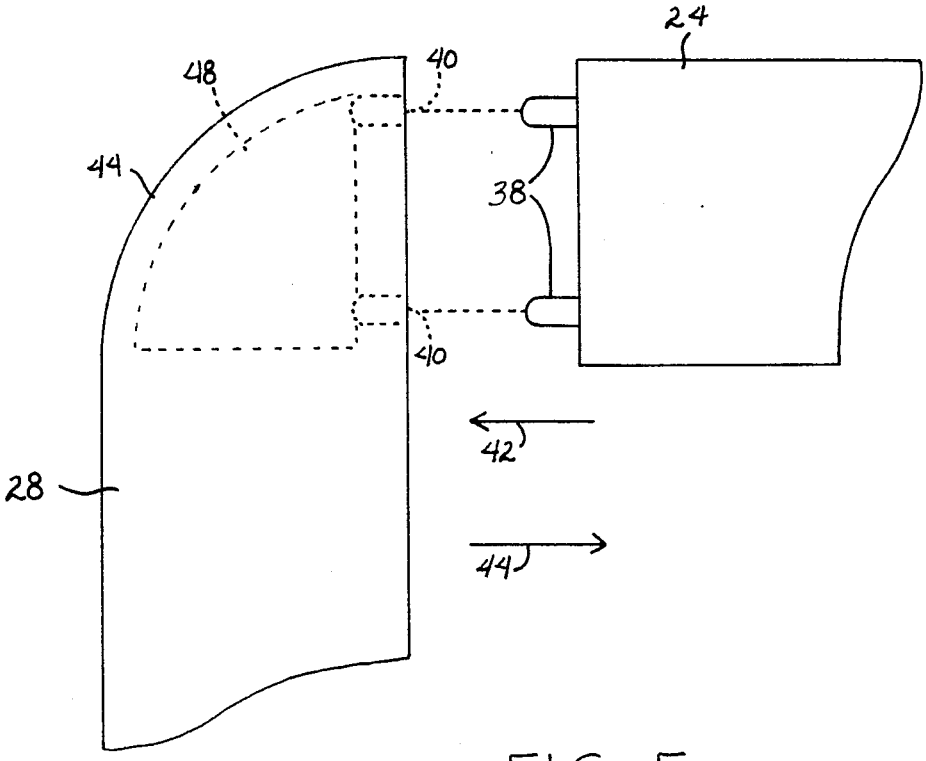
FIG. 5 is a top view of two adjoining sides of the base frame.

Sides 18, 20 and 22 of base 14 are selectively interconnected so that the base may be quickly and conveniently assembled and disassembled. As shown in FIG. 3, a pair of spaced apart dowels 38 are attached to and extend from each end of the upper and lower frame elements 24 and 26. Dowels 38 are introduced into respective holes 40 formed along the inside edges of upper and lower frame elements 32 and 34 of right side 22 and upper and lower frame elements 28 and 30 of left side 20. The sides of base 14 may be interconnected by inserting the dowels 38 into their respective holes 40 in the direction of arrow 42, FIG. 5. The base may be subsequently disassembled for storage or transport by removing the dowels 38 from the holes in the direction of arrow 44.

Left and right sides 20 and 22 are curved or angled at the ends proximate front side 19. More particularly, as shown in FIG. 3, upper and lower frame elements 28 and 30 of side 20 include respective curved portions 44 and 46 and side 22 includes similar curved portions. Curved portions 44 and 46 generally conform to the curved outer face of the glass block **17*a* formed at the end of the row of glass blocks in the respective side. Typically, each glass block 17*a* is somewhat larger than its adjacent glass block. Accordingly, each of the frame elements 28, 30 and 32, 34 is provided with a curved recessed portion 48, FIG. 5 which accommodates either the top or bottom of a respective block 17*a*. In alternative embodiments, the corner blocks 17*a* may have faces which are angled or multifaceted and not necessarily curved in the manner shown in FIG. 5. Typically, however, in all embodiments, a smooth, even and aesthetically pleasing transition is made between the end blocks 17*a* of sides 20 and 22 and the glass blocks in forward side 19**.

As shown in FIGS. 1 and 2, platform portion 12 includes a generally horizontal upper part 50 and a lower part 52 that is attached to and depends from part 50. Upper part 50 extends somewhat beyond lower part 52 and the lower part 52 depends generally perpendicularly from upper part 50.

As shown most clearly in FIG. 3, platform 12 includes a pair of half sections 54 and 56. Each half section includes approximately one half of upper part 50 and one half of lower part 52. Within each half section 54 and 56 the lower part 52 may be formed from a single elongate piece that includes side portions 65 and an end portion 67. Alternatively, the side portions and the end portion may comprise distinct pieces which are secured together by various attachment means. Lower part 52 may be unadorned as shown in FIG. 3. Alternatively, as shown in FIGS. 1 and 2, individual tiles 53 may be applied to the outwardly facing surfaces of lower part 52 and secured thereto by a suitable adhesive.

A cross brace 57 is formed transversely across each half section 54, 56 beneath upper part 54 and extends between opposite sides of lower part 52. Means are provided for selectively interconnecting the half sections 54 and 56. In particular, dowels, not shown, extend from the inside upper edge 58 of half section 54. These dowels are received by complementary holes 60 formed in the inside upper edge 62 of half section 56.

Platform portion 12 is removably and slidably mounted to base portion 14. In particular, dowels 64 extend from the bottom edge of lower part 52 of platform portion 12. Each dowel 64 extending from the lower edge of portions 65 of parts 52 is received within an elongate groove 70 that is formed in the upper surface of a respective upper frame element 28 and 32. The dowels 64 that extend from portion 67 of half section 54 are received by complementary holes 76 in frame element 24. As a result, half section 54 is secured in place. Conversely, dowels 64 of half section 56 slide within grooves 70. This enables section 56 to be separated from section 54 by sliding section 56 in the direction of arrow 78, FIGS. 2 and 3.

A light source 80, FIG. 3, is mounted beneath section 56 of platform portion 12. Light source 80 may be an incandescent or fluorescent light which is controlled by a dimmer switch 81 mounted to lower part 52. The light source is connected to a socket in a conventional manner by a plug 82. A separate wiring harness may be provided through opening 85 in platform portion 56 to activate a headboard lamp 83. In various embodiments, multiple lights may be utilized beneath the platform. The light may be attached, as shown, in some manner to the inside of the base or platform, or alternatively, may be simply placed upon the floor. In the disclosed embodiment the light source is permanently wired within casing 87 and all wiring meets N.E.C. specifications. To change or replace light source 80, the half sections of platform portion 12 are simply separated as described above so that access is provided to the light.

Light source 80 is illuminated so that light is diffused through glass blocks 17. As a result, a unique aesthetic appearance is provided. This appearance may be further altered by tinting light source 80 or the glass blocks 17. Different glass block patterns will also give different lighting effects.

The bed 10 may be assembled quickly and conveniently by fitting the individual pieces together as described above. The bed may be just as easily disassembled for transportation and storage by separating the half sections 54 and 56, removing those half sections from the base 14, and breaking down the base into the individual side pieces 19, 20 and 22.

Figure 6:
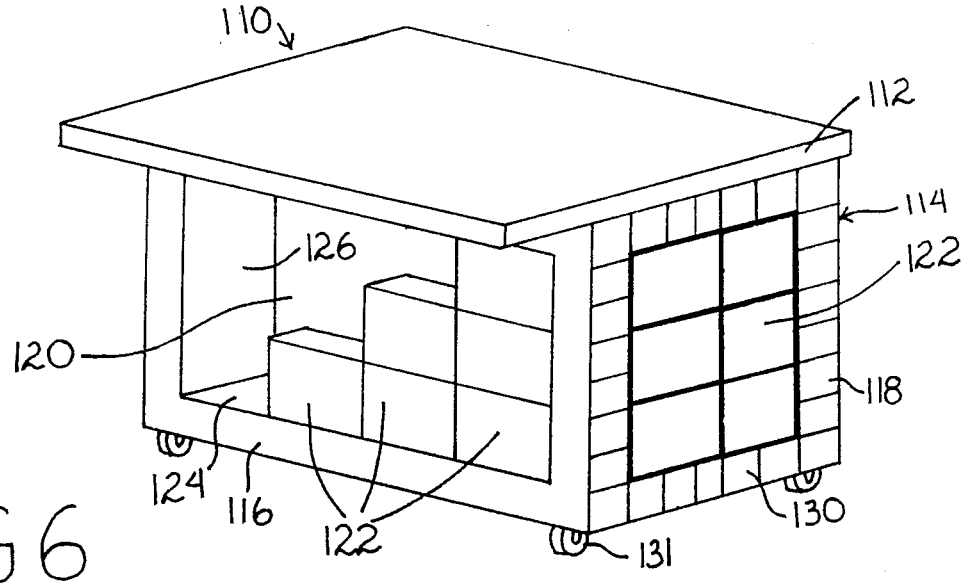
FIG. 6 is an isometric view of a bar that is constructed according to this invention.
Figure 7:
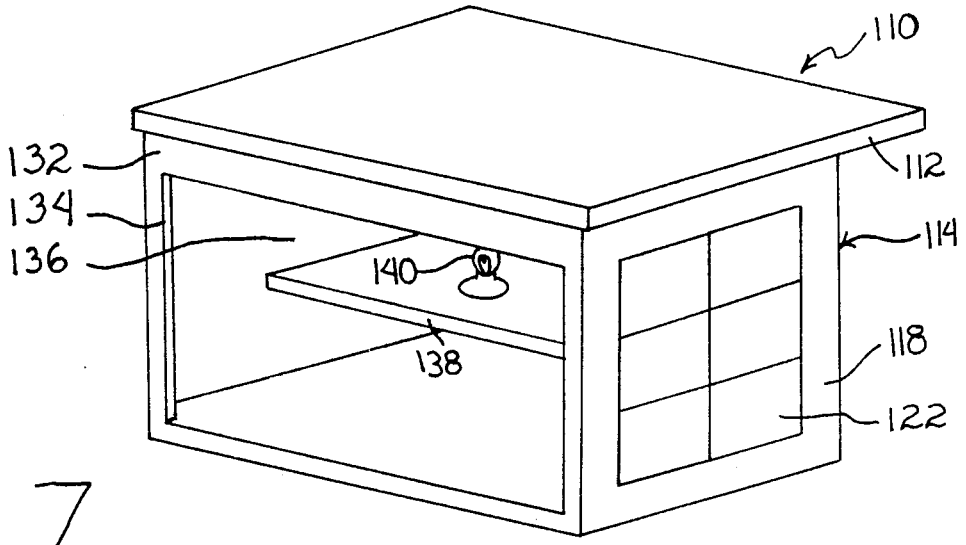
FIG. 7 is an isometric view of the opposite side of the bar of FIG. 6.

An alternative article of furniture constructed according to this invention includes a bar 110, shown in FIGS. 6 and 7. Bar 110 includes an upper platform 112 that forms a counter top and a base 114 that supports platform 112.

As shown in FIG. 6, base 114 includes a forward wall 116 and a pair of side walls 118, only one of which is shown. The walls may be formed of wood or any other suitable material and, in particular, may comprise a plywood outer surface that is supported by a skeletal frame. An opening 120 is formed in wall 116 and that opening is filled by a plurality of glass blocks 122, only a few of which are shown. A bottom row of glass blocks are seated upon a ledge 124, which surrounds opening 120 and additional rows of glass blocks are stacked upon the lowest row so that the opening is entirely filled. The adjacent glass blocks 122 are secured together by adhesive means, as previously described. The outer blocks are likewise secured to the inside edges of opening 120 and more particularly, for example, to ledge 124 sides 126 and a top edge, not shown. Wall 116 thereby forms a frame that encloses glass blocks 122.

Side walls 18 include a similar structure. A plurality of rows of glass blocks 122 are formed within a similar opening in each side. A plurality of ornamental tiles 130 may be applied to one or more of the surfaces of walls 116 and 118. Casters 131 allow the bar to be transported readily.

As shown in FIG. 7, the rearward wall 132 of base 118 includes an opening 134 that provides access into a compartment 136. One or more shelves 138 may be mounted within compartment 136 in a similar manner. A light source 140 is mounted within compartment 136. The light source 140 may be mounted, for example, on a shelf 138 or at any other convenient location within the compartment of the bar 110.

Figure 8:
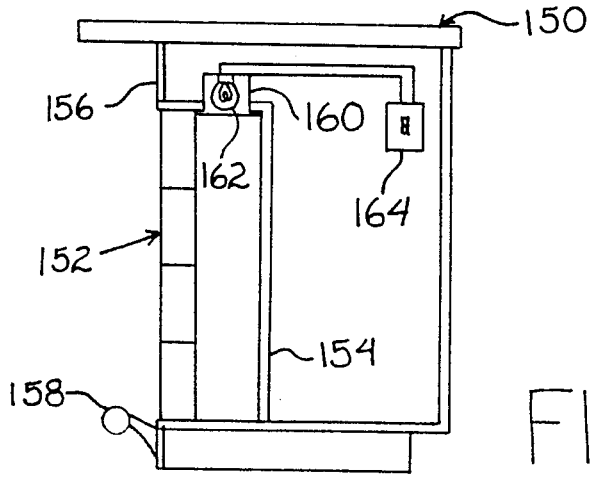
FIG. 8 is a cross sectional view of an alternative bar.

In the alternative bar 150 shown in FIG. 8, glass blocks 152 are mounted within a casing 154 that is constructed within the bar. The base of the bar also includes a forward wall 156 and a foot rail 158 that is attached thereto. One or more light fixtures 160 are mounted to casing 154 such that light from bulb 162 illuminates the inside of casing 154. As a result, diffuse illumination is provided through glass blocks 152. The light source is controlled by a switch 164 mounted to an inside wall of bar 150.

Although specific features of the invention are shown in some drawings and not in others, this is for convenience only, as each feature may be combined with any or all of the other features in accordance with the invention. Other embodiments will occur to those skilled in the art and are within the following claims.

What is claimed is:

1. An article of furniture comprising:

a generally planar platform portion;

a base portion for supporting said platform portion, said base portion including a plurality of interengaged glass blocks and a frame for enclosing said glass blocks; and a light source disposed beneath said platform portion for providing illumination through said glass blocks.

2. The article of claim 1 further including means for interconnecting said platform portion with said base portion.

3. The article of claim 1 in which said means for interconnecting include dowel means that extend from one of said platform portions and said base portion, and receptacle means formed in the other of said platform portion and said base portion for receiving said dowel means.

4. The article of claim 3 in which said receptacle means includes groove means for slidable receiving said dowel means such that said platform may be adjusted relative to said base portion.

5. The article of claim 1 in which said platform includes a pair of separable half sections.

6. The article of claim 5 further including means for selectively interconnecting said half sections.

7. The article of claim 1 in which said platform portion includes a generally horizontal part and a peripheral part that depends from said horizontal part.

8. The article of claim 7 further including tile means that are attached to said peripheral part of said platform portion.

9. The article of claim 1 in which said base portion includes at least a single row of glass blocks.

10. The article of claim 1 in which said frame includes a plurality of selectively interconnected sides.

11. The article of claim 1 further including means for adhering said glass blocks to said frame.

12. The article of claim 10 further including means for adhering the adjacent blocks in a respective one of said sides.

13. The article of claim 1 further including a molding element that interconnects said glass block and said frame.

14. The article of claim 1 in which said base includes a plurality of sides and a plurality of junction sections which interconnect said sides; each said junction section including a glass block that has one of a curved and angled outer face and upper and lower frame elements disposed respectively above and below said glass block.

15. The article of claim 1 in which said frame portion includes a plurality of tiles mounted to the outer face thereof.

16. The article of claim 1 in which said base includes a compartment having an opening thereto and shelving means disposed in said compartment.

* * * * *